US011588266B2

(12) United States Patent
Chiang

(10) Patent No.: US 11,588,266 B2
(45) Date of Patent: Feb. 21, 2023

(54) COAXIAL CONNECTOR

(71) Applicant: BO-JIANG TECHNOLOGY CO., LTD., Tainan (TW)

(72) Inventor: Chang-Hui Chiang, Tainan (TW)

(73) Assignee: BO-JIANG TECHNOLOGY CO., LTD., Tainan (TW)

( * ) Notice: Subject to any disclaimer, the term of this patent is extended or adjusted under 35 U.S.C. 154(b) by 5 days.

(21) Appl. No.: 17/366,011

(22) Filed: Jul. 1, 2021

(65) Prior Publication Data

US 2022/0328995 A1 Oct. 13, 2022

(30) Foreign Application Priority Data

Apr. 7, 2021 (TW) ..... 110203717

(51) Int. Cl.

| | |
|---|---|
| ***H01R 9/05*** | (2006.01) |
| ***H01R 13/41*** | (2006.01) |
| ***H01R 24/50*** | (2011.01) |
| *H01R 103/00* | (2006.01) |

(52) U.S. Cl.

CPC ..... *H01R 13/41* (2013.01); *H01R 24/50* (2013.01); *H01R 2103/00* (2013.01)

(58) Field of Classification Search

CPC ..... H01R 13/41; H01R 24/50; H01R 2103/00
See application file for complete search history.

(56) References Cited

U.S. PATENT DOCUMENTS

| | | | | |
|---|---|---|---|---|
| 5,217,391 | A * | 6/1993 | Fisher, Jr. | H01R 24/44 439/578 |
| 5,921,793 | A * | 7/1999 | Phillips | H01R 24/44 439/944 |
| 7,530,842 | B1 * | 5/2009 | Hsu | H01R 9/0521 439/578 |
| 10,658,791 | B2 * | 5/2020 | Chiang | H01R 13/627 |
| 2006/0172579 | A1 * | 8/2006 | Murphy | H01R 9/05 439/307 |
| 2010/0233904 | A1 * | 9/2010 | Stone | H01R 13/6277 439/578 |
| 2020/0044387 | A1 * | 2/2020 | Chiang | H01R 13/627 |
| 2021/0313746 | A1 * | 10/2021 | Kato | H04N 5/2251 |
| 2021/0384680 | A1 * | 12/2021 | Yamazaki | H01R 12/7082 |
| 2022/0115813 | A1 * | 4/2022 | Tsuchiya | H01R 24/52 |

* cited by examiner

*Primary Examiner* — Abdullah A Riyami
*Assistant Examiner* — Nelson R. Burgos-Guntin
(74) *Attorney, Agent, or Firm* — Li & Cai Intellectual Property Office

(57) ABSTRACT

A coaxial connector is provided. The coaxial connector includes a shell, a first fixing member, a second fixing member, and a core body. The first fixing member and the second fixing member are disposed in a fixing thru-hole of the shell. One end of the first fixing member abuts against one end of the second fixing member. One portion of the core body is disposed in the first fixing member and the second fixing member. An inner diameter of a first inner engaging portion of the first fixing member changes with a length thereof, and an inner diameter of a second inner engaging portion of the second fixing member is uniform. An outer diameter of an engaging portion of the core body changes with a length thereof, and an outer diameter of an auxiliary engaging portion of the core body is uniform.

11 Claims, 9 Drawing Sheets

100

COAXIAL CONNECTOR

CROSS-REFERENCE TO RELATED PATENT APPLICATION

This application claims the benefit of priority to Taiwan Patent Application No. 110203717, filed on Apr. 7, 2021. The entire content of the above identified application is incorporated herein by reference.

Some references, which may include patents, patent applications and various publications, may be cited and discussed in the description of this disclosure. The citation and/or discussion of such references is provided merely to clarify the description of the present disclosure and is not an admission that any such reference is "prior art" to the disclosure described herein. All references cited and discussed in this specification are incorporated herein by reference in their entireties and to the same extent as if each reference was individually incorporated by reference.

FIELD OF THE DISCLOSURE

The present disclosure relates to a connector, and more particularly to a coaxial connector.

BACKGROUND OF THE DISCLOSURE

A conventional coaxial connector primarily includes a shell, an insulating fixing member, and a core body. The shell has a thru-hole penetrating through the shell. The insulating fixing member is disposed in the thru-hole. The insulating fixing member has a central thru-hole penetrating through the insulating fixing member. The core body penetrates through the central thru-hole. The core body has an annular barb structure. An outer diameter of the annular barb structure is greater than an inner diameter of the central thru-hole, and the core body can be fixed in the insulating fixing member in tight cooperation through the annular barb structure. One end of the core body is exposed from the shell, and one portion of the core body that is exposed from the shell abuts against a conductive pad of a circuit board.

Generally, when the core body and the insulating fixing member are fixed with each other through the annular barb structure, a size of the one portion of the core body exposed from the shell is sometimes too small, such that the one end of the core body cannot firmly abut against the conductive pad of the circuit board.

Generally, the insulating fixing member is made of an elastic material. When the conventional coaxial connector is fixed to the circuit board by a user, the one portion of the core body that is exposed from the shell is pushed inwards toward the shell. At this time, the core body may move relative to the insulating fixing member, so that an obvious abrasion occurs between the annular barb structure and the insulating fixing member. Therefore, a connection strength between the core body and the insulating fixing member may be affected, such that the one end of the core body is not stably in contact with the conductive pad of the circuit board, and the conventional coaxial connector cannot effectively transmit signals.

In addition, during an assembling process of the core body, if a technical personnel notices that a length of the one end of the core body exposed from the shell is not long enough, the technical personnel may usually try pushing against the core body. When the technical personnel pushes against the core body, abrasion between the annular barb structure and the insulating member occurs, thereby affecting the connection strength between the core body and the insulating fixing member.

SUMMARY OF THE DISCLOSURE

In response to the above-referenced technical inadequacies, the present disclosure provides a coaxial connector to improve upon an issue associated with a conventional coaxial connector (e.g., when the conventional coaxial connector is mounted onto a circuit board, one end of a core body is in poor contact with a conductive pad of the circuit board, so that a signal transmission effect is not good).

In one aspect, the present disclosure provides a coaxial connector. The coaxial connector includes a shell, a first fixing member, a second fixing member, and a core body. The shell has a fixing thru-hole penetrating through the shell along an axial direction. The first fixing member has a first thru-hole penetrating through the first fixing member along the axial direction. The first fixing member includes a first inner annular portion and a first inner engaging portion. The first inner annular portion has an annular structure. The first inner engaging portion has an annular structure. The first inner engaging portion is connected to the first inner annular portion, an inner diameter of the first inner engaging portion gradually increases from one end of the first fixing member to another end of the first fixing member, and the first inner engaging portion has an inner annular abutting inclined surface formed therein. The second fixing member has a second thru-hole penetrating through the second fixing member along the axial direction. The second fixing member includes a second inner annular portion and a second inner engaging portion. The second inner annular portion has an annular structure. The second inner annular portion has an inner annular end surface at one end thereof. The second inner engaging portion has an annular structure. The second inner engaging portion is connected to the second inner annular portion, an inner diameter of the second inner engaging portion is greater than an inner diameter of the second inner annular portion, and the inner diameter of the second inner engaging portion is uniform from one end of the second fixing member to another end of the second fixing member. The first fixing member and the second fixing member are engaged in the fixing thru-hole of the shell, and an end surface of the first fixing member and an end surface of the second fixing member abut against each other. The core body includes a first portion, a second portion, an engaging portion, and an auxiliary engaging portion. The engaging portion is arranged between the first portion and the second portion. An outer diameter of the engaging portion gradually increases from one end of the core body to another end of the core body, the engaging portion has an outer annular abutting inclined surface, a minimum outer diameter of the engaging portion is greater than or equal to an outer diameter of the first portion, and a maximum outer diameter of the engaging portion is greater than an outer diameter of the second portion. A length of the engaging portion along the axial direction is greater than a length of the first inner engaging portion along the axial direction. The auxiliary engaging portion is connected to one end of the engaging portion having the maximum outer diameter. An outer diameter of the auxiliary engaging portion is equal to the maximum outer diameter of the engaging portion, the outer diameter of the auxiliary engaging portion is uniform, and the auxiliary engaging portion has an outer annular end surface at an end thereof opposite to a position where the auxiliary engaging portion is connected to the engaging portion. One portion of the core body penetrates through the first thru-hole, the one portion of the core body penetrates through the second thru-hole, the first inner engaging portion and the second inner engaging portion jointly hold the engaging portion and the auxiliary engaging portion together, the inner annular abutting inclined surface and one portion of the outer annular abutting inclined surface abut against each other, and the outer annular end surface and the inner annular end surface abut against each other.

Therefore, through the above design of the shell, the first fixing member, the second fixing member, and the core body, when the coaxial connector of the present disclosure is fixed to a circuit board, one end of the core body can effectively be in contact with a conductive pad of the circuit board, so that the coaxial connector can stably transmit signals.

These and other aspects of the present disclosure will become apparent from the following description of the embodiment taken in conjunction with the following drawings and their captions, although variations and modifications therein may be affected without departing from the spirit and scope of the novel concepts of the disclosure.

BRIEF DESCRIPTION OF THE DRAWINGS

The described embodiments may be better understood by reference to the following description and the accompanying drawings, in which.

DETAILED DESCRIPTION OF THE EXEMPLARY EMBODIMENTS

Figure 1:
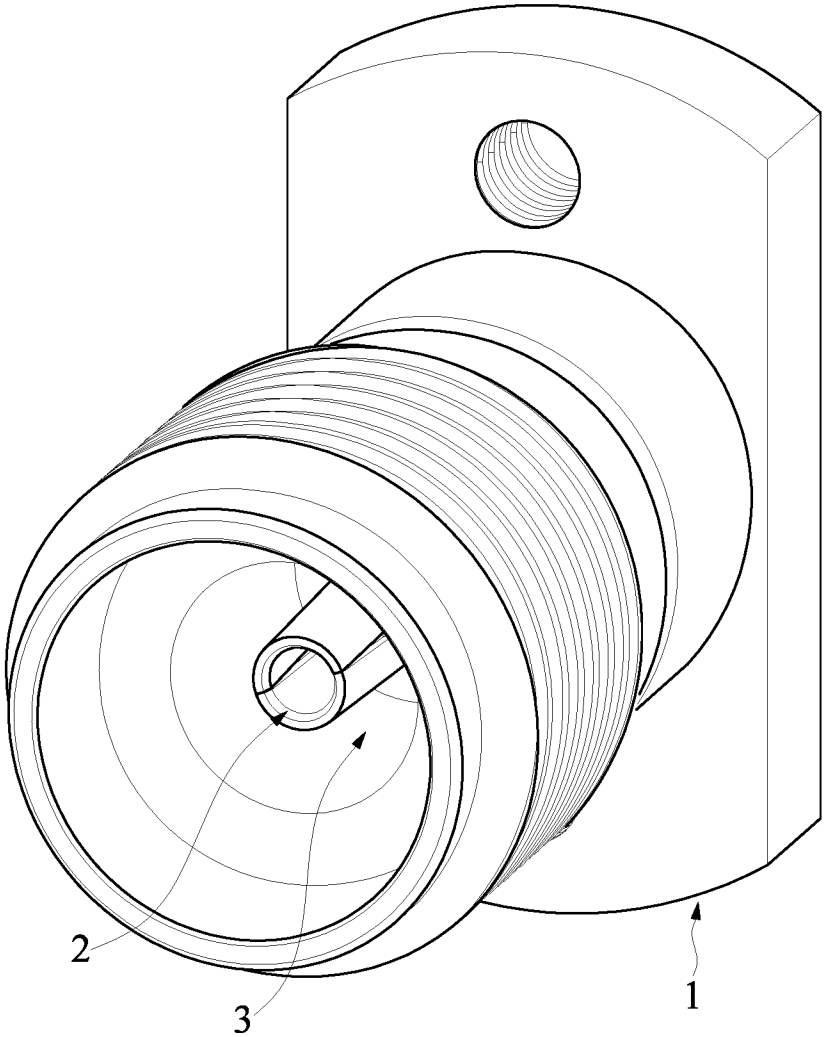
FIG. 1 is a perspective view of a coaxial connector according to the present disclosure.
Figure 2:
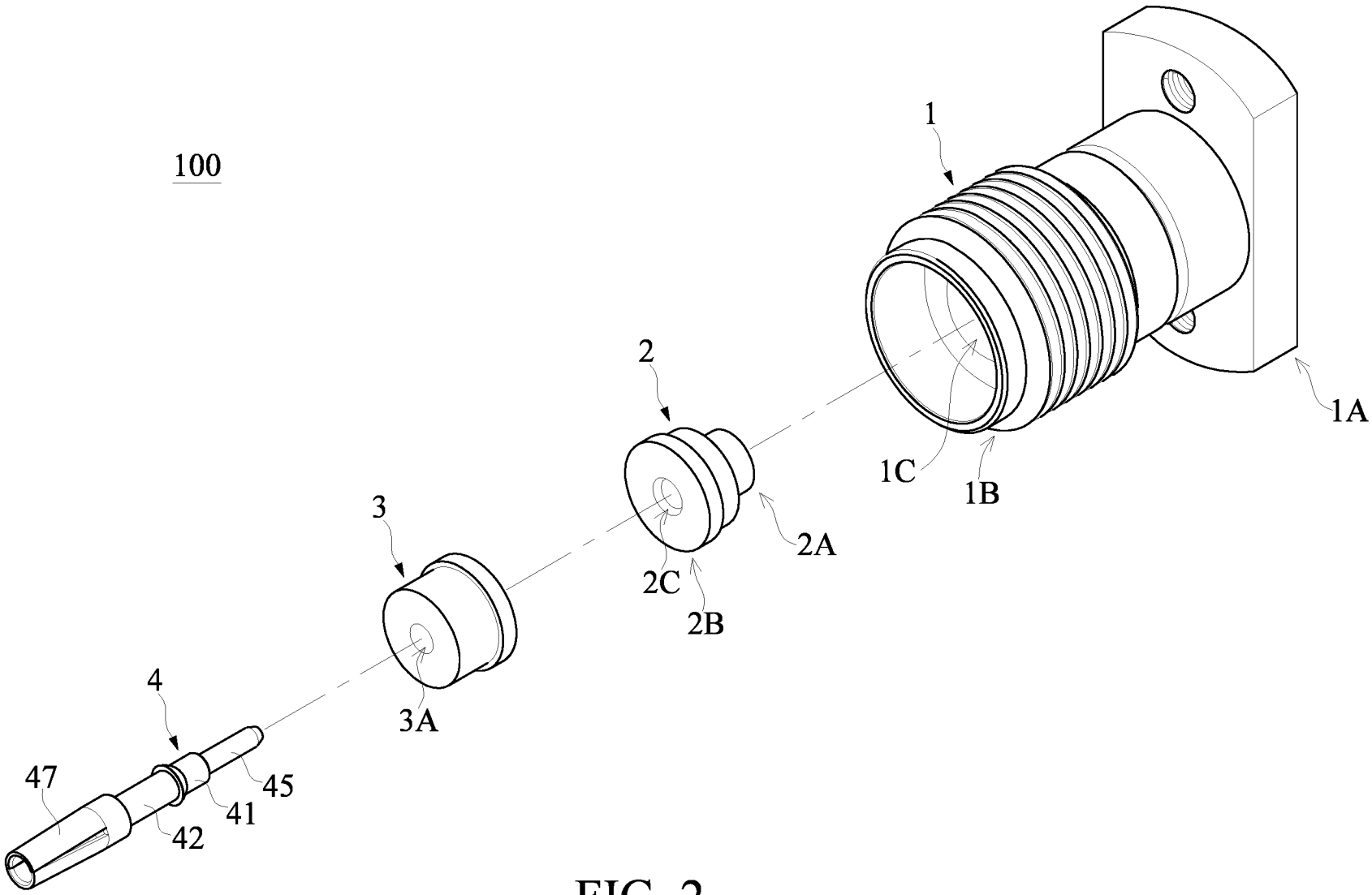
FIG. 2 is a perspective exploded view of the coaxial connector according to the present disclosure.

The present disclosure is more particularly described in the following examples that are intended as illustrative only since numerous modifications and variations therein will be apparent to those skilled in the art. Like numbers in the drawings indicate like components throughout the views. As used in the description herein and throughout the claims that follow, unless the context clearly dictates otherwise, the meaning of "a", "an", and "the" includes plural reference, and the meaning of "in" includes "in" and "on". Titles or subtitles can be used herein for the convenience of a reader, which shall have no influence on the scope of the present disclosure.

The terms used herein generally have their ordinary meanings in the art. In the case of conflict, the present document, including any definitions given herein, will prevail. The same thing can be expressed in more than one way. Alternative language and synonyms can be used for any term(s) discussed herein, and no special significance is to be placed upon whether a term is elaborated or discussed herein. A recital of one or more synonyms does not exclude the use of other synonyms. The use of examples anywhere in this specification including examples of any terms is illustrative only, and in no way limits the scope and meaning of the present disclosure or of any exemplified term. Likewise, the present disclosure is not limited to various embodiments given herein. Numbering terms such as "first", "second" or "third" can be used to describe various components, signals or the like, which are for distinguishing one component/signal from another one only, and are not intended to, nor should be construed to impose any substantive limitations on the components, signals or the like.

Referring to FIG. 1 to FIG. 8, a coaxial connector 100 of the present disclosure includes a shell 1, a first fixing member 2, a second fixing member 3, and a core body 4. The first fixing member 2 and the second fixing member 3 can each be made of an insulating material, and the first fixing member 2 and the second fixing member 3 are primarily configured to allow the core body 4 to be fixed in the shell 1. The core body 4 can transmit a signal, and the core body 4 is made of a conductive material. A material forming the first fixing member 2 can be an elastic insulating material, and a material forming the second fixing member 3 can also be an elastic insulating material.

The shell 1 defines a first end 1A and a second end 1B opposite to each other, and the shell 1 has a fixing thru-hole 1C penetrating through the shell 1 along an axial direction D. The shell includes a first outer annular portion 11, a second outer annular portion 12, an outer engaging portion 13, a connection portion 14, and an outer end portion 15. The shell 1 sequentially includes the outer end portion 15, the connection portion 14, the first outer annular portion 11, the outer engaging portion 13, and the second outer annular portion 12 from the first end 1A to the second end 1B. The fixing thru-hole 1C penetrates through the first outer annular portion 11, the second outer annular portion 12, the outer engaging portion 13, the connection portion 14, and the outer end portion 15. In other embodiments, the shell 1 can be provided to not include the connection portion 14 and the outer end portion 15.

The first outer annular portion 11 has an annular structure and is near the first end 1A. The second outer annular portion 12 has an annular structure and is near the second end 1B. The outer engaging portion 13 has an annular structure and is arranged between the first outer annular portion 11 and the second outer annular portion 12. An inner diameter 13D of the outer engaging portion 13 is greater than an inner diameter 11D of the first outer annular portion 11, and the inner diameter 13D of the outer engaging portion 13 is greater than an inner diameter 12D of the second outer annular portion 12. The inner diameter 13D of the outer engaging portion 13 is uniform from the first end 1A to the second end 1B, the inner diameter 11D of the first outer annular portion 11 is uniform from the first end 1A to the second end 1B, and the inner diameter 12D of the second outer annular portion 12 is uniform from the first end 1A to the second end 1B.

The connection portion 14 has an annular structure, the outer end portion 15 has an annular structure, the connection portion 14 is connected to the first outer annular portion 11, the connection portion 14 is also connected to the outer end portion 15, the connection portion 14 is arranged between the first outer annular portion 11 and the outer end portion 15, an inner diameter 14D of the connection portion 14 is less than the inner diameter 11D of the first outer annular portion 11, and an inner diameter 15D of the outer end portion 15 is less than the inner diameter 14D of the connection portion 14.

A proportion between each of a length of the outer end portion 15, a length of the connection portion 14, a length of the first outer annular portion 11, a length of the outer engaging portion 13, and a length of the second outer annular portion 12 along the axial direction D and a length of the shell 1 along the axial direction D can be adjusted according to a frequency of the signal required to be transmitted, and the present disclosure is not limited thereto.

Figure 3:
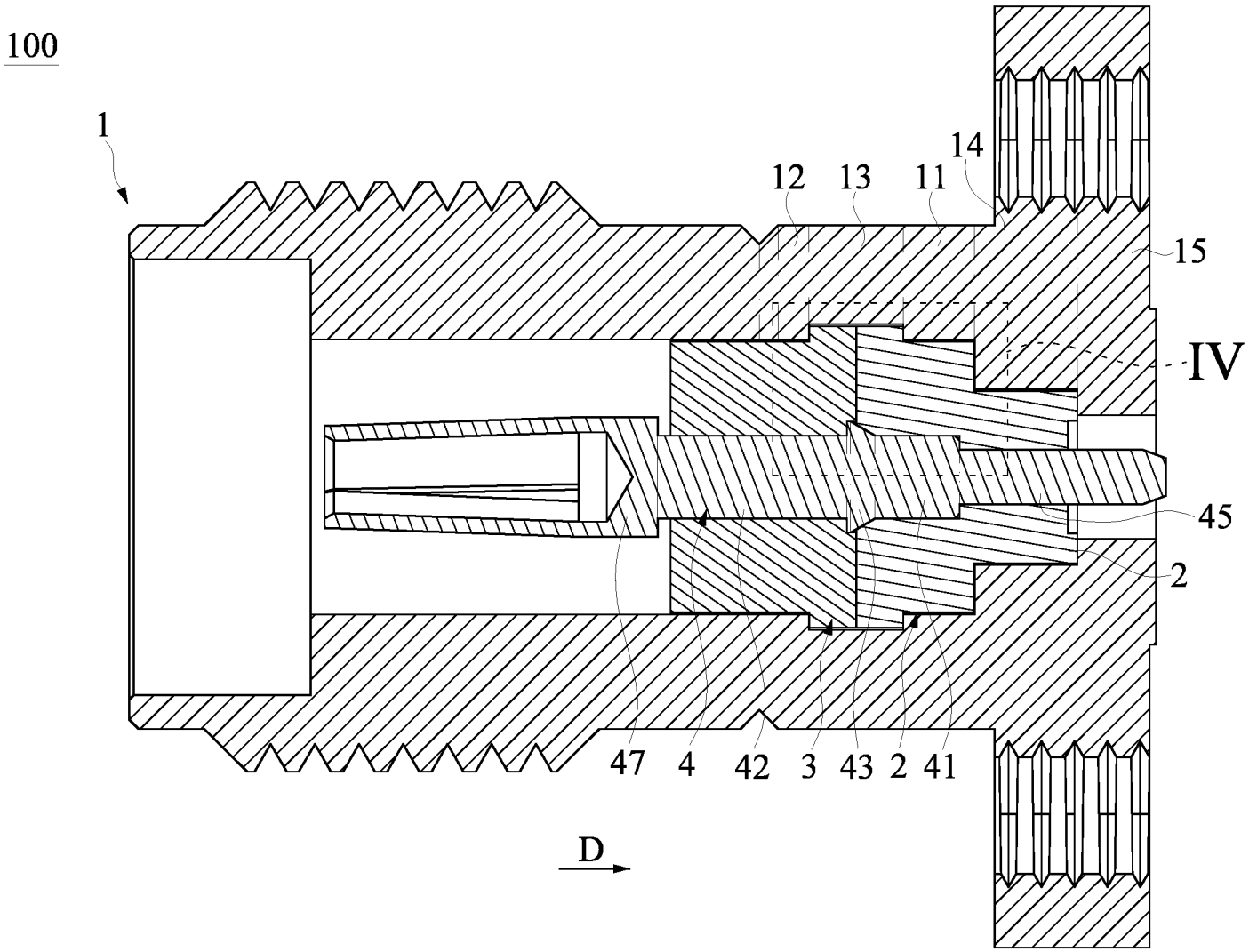
FIG. 3 is a sectional view of the coaxial connector according to the present disclosure.
Figure 4:
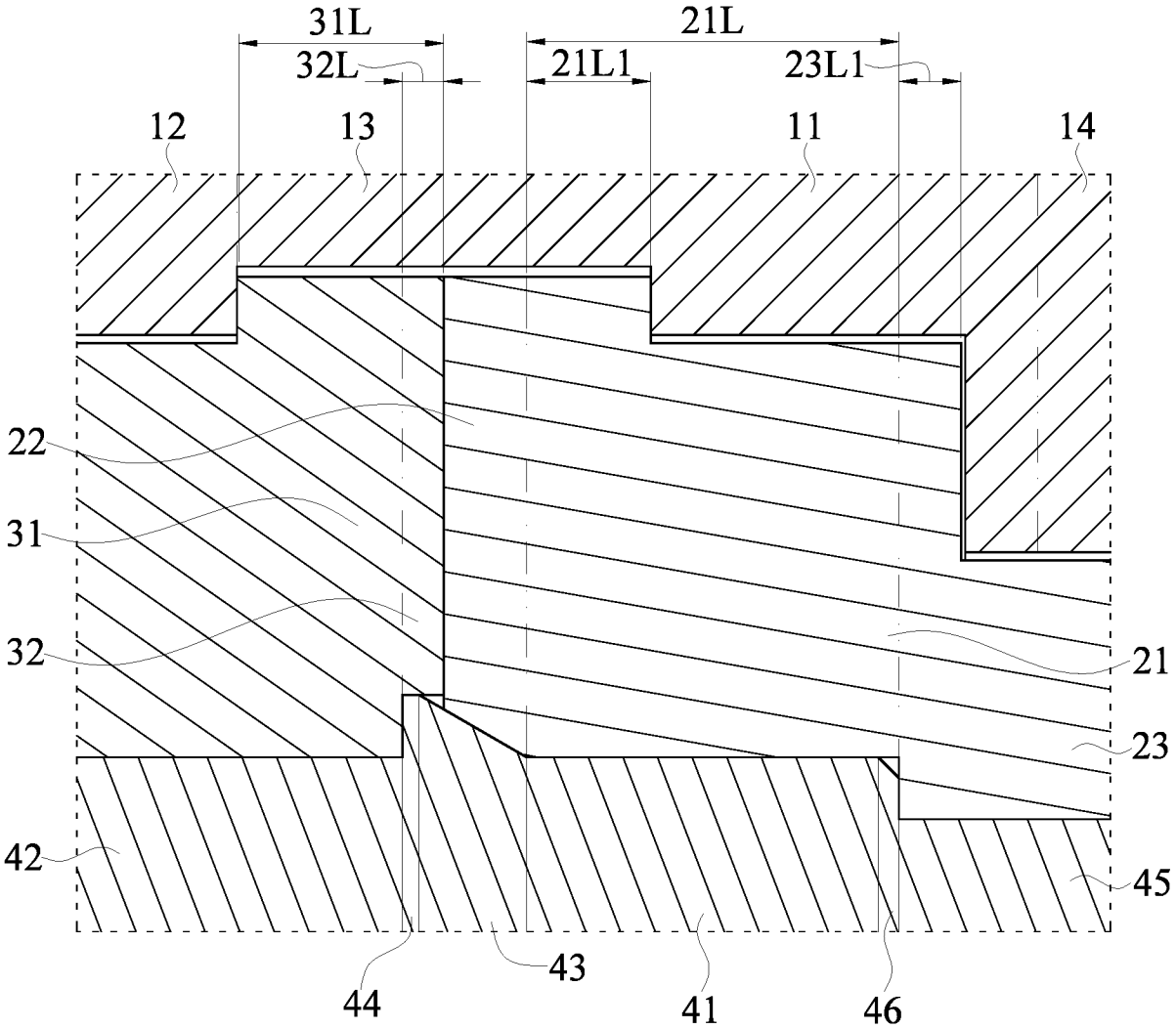
FIG. 4 is a partial enlarged view of FIG. 3.
Figure 6:
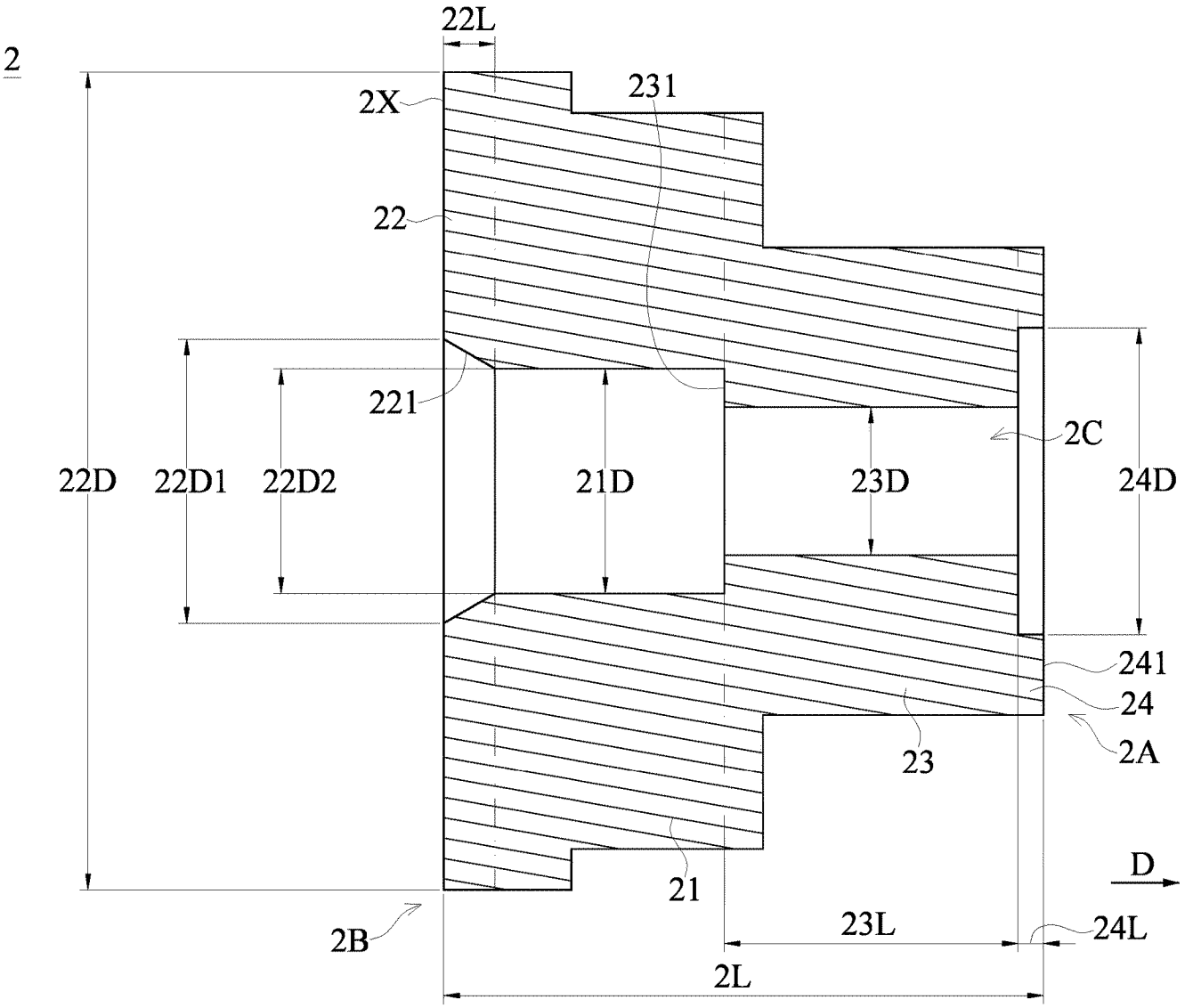
FIG. 6 is a sectional view of a first fixing member of the coaxial connector according to the present disclosure.

Referring to FIG. 3, FIG. 4, and FIG. 6, the first fixing member 2 has a first thru-hole 2C penetrating through the first fixing member 2 along the axial direction D. The first fixing member 2 includes a first inner annular portion 21, a first inner engaging portion 22, a first inner end portion 23, and an auxiliary portion 24. When the first fixing member 2 is fixed in the shell 1, the first fixing member 2 sequentially includes the auxiliary portion 24, the first inner end portion 23, the first inner annular portion 21, and the first inner engaging portion 22 from one end near the first end 1A to another end near the second end 1B.

In other embodiments, the first fixing member 2 can be provided to not include the first inner end portion 23. The first thru-hole 2C penetrates through the first inner annular portion 21, the first inner engaging portion 22, and the first inner end portion 23. A length 2L of the first fixing member 2 along the axial direction D is less than a length 1L of the fixing thru-hole 1C of the shell 1 along the axial direction D, and the first fixing member 2 is engaged in the shell 1. The first inner end portion 23 is near the outer end portion 15, and the first inner engaging portion 22 is near the outer engaging portion 13.

The first inner annular portion 21 has an annular structure. An inner diameter 21D of the first inner annular portion 21 is uniform from one end of the first fixing member 2 to another end of the first fixing member 2. The first inner engaging portion 22 has an annular structure, the first inner engaging portion 22 is connected to the first inner annular portion 21, an inner diameter of the first inner engaging portion 22 gradually increases from the one end of the first fixing member 2 (i.e., one end of the first engaging portion 22 near the first inner annular portion 21) to the another end of the first fixing member 2, and the first inner engaging portion 22 has an inner annular abutting inclined surface 221 formed therein. In a practical application, the inner diameter 21D of the first inner annular portion 21 can be substantially equal to a minimum inner diameter 22D2 of the first inner engaging portion 22. A length 22L of the first inner engaging portion 22 along the axial direction D is less than the length 2L of the first fixing member 2 along the axial direction D. The first inner end portion 23 has an annular structure. An inner diameter 23D of the first inner end portion 23 is uniform from the one end of the first fixing member 2 to the another end of the first fixing member 2.

The auxiliary portion 24 has an annular structure. An inner diameter 24D of the auxiliary portion 24 is uniform from the one end of the first fixing member 2 to the another end of the first fixing member 2. The inner diameter 24D of the auxiliary portion 24 is greater than the inner diameter 23D of the first inner end portion 23. In a preferred embodiment, a length 24L of the auxiliary portion 24 along the axial direction D is less than the length 2L of the first fixing member 2 along the axial direction D.

Figure 5:
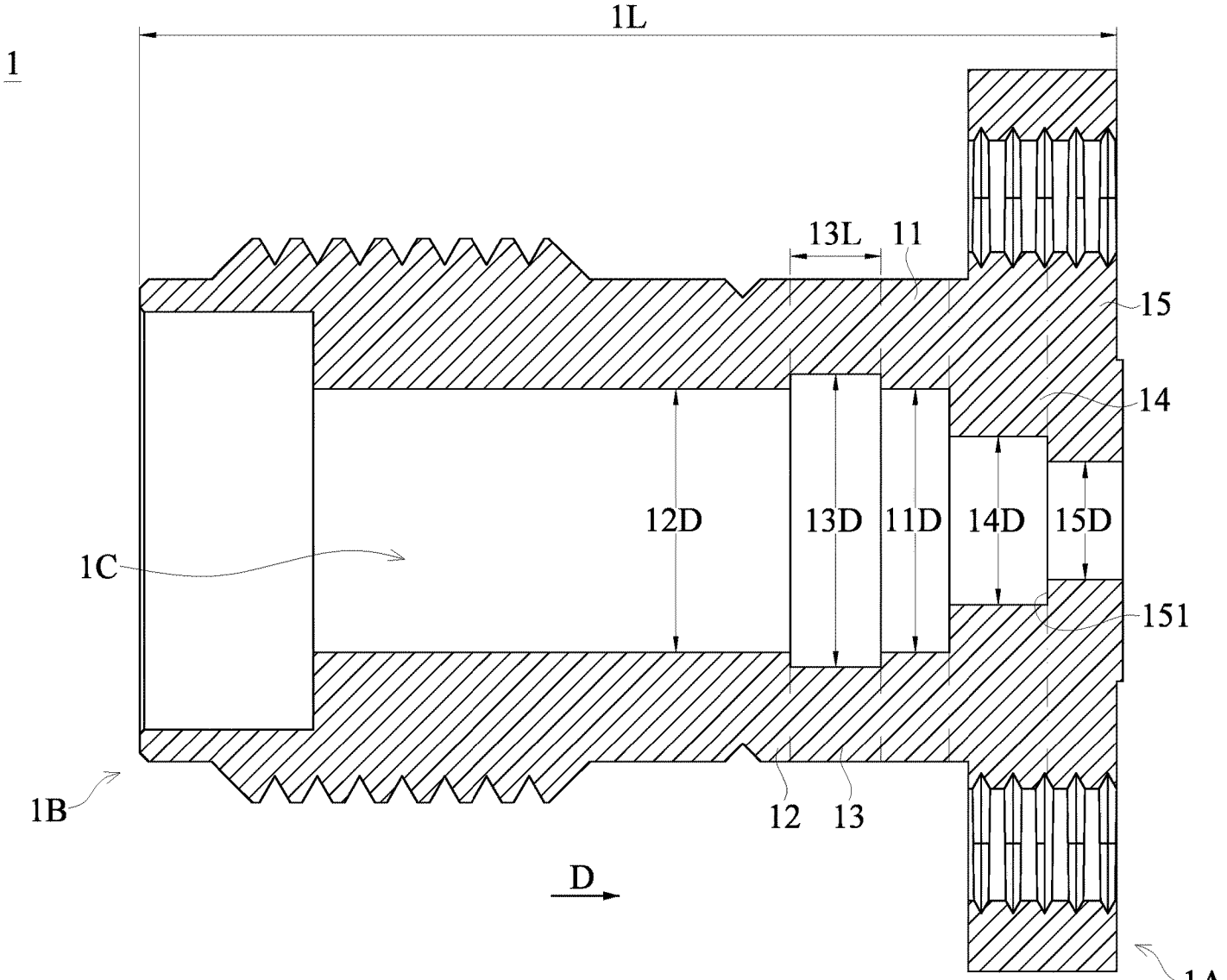
FIG. 5 is a sectional view of a shell of the coaxial connector according to the present disclosure.

In a practical manufacturing design, through adjusting any one of the length 24L of the auxiliary portion 24 along the axial direction D, the inner diameter 24D of the auxiliary portion 24, and a difference between an outer diameter 45D of an abutting portion 45 and the inner diameter 24D of the auxiliary portion 24, the coaxial connector 100 can reach an impedance matching requirement. In addition, in other embodiments, when the first fixing member 2 is engaged in the shell, a gap is formed between an end surface 241 (as shown in FIG. 6) of the auxiliary portion 24 opposite from the first inner end portion 23 and an inner end surface 151 (as shown in FIG. 5) of the outer end portion 15, and a technical personnel can adjust a length of the gap along the axial direction D to allow the coaxial connector 100 to reach the impedance matching requirement.

When the first fixing member 2 is fixed in the shell 1, the first inner engaging portion 22 and one portion of the first inner annular portion 21 are engaged in the outer engaging portion 13, another portion of the first inner annular portion 21 and one portion of the first inner end portion 23 are engaged in the first outer annular portion 11, and another portion of the first inner end portion 23 is engaged in the connection portion 14.

In a preferred embodiment, a length 21L1 of a section of the first inner annular portion 21 engaged in the outer engaging portion 13 along the axial direction D is less than the length 21L of the first inner annular portion 21 along the axial direction D. A length 23L1 of a section of the first inner end portion 23 engaged in the first outer annular portion 11 along the axial direction D is less than the length 23L of the first inner end portion 23 along the axial direction D.

Figure 7:
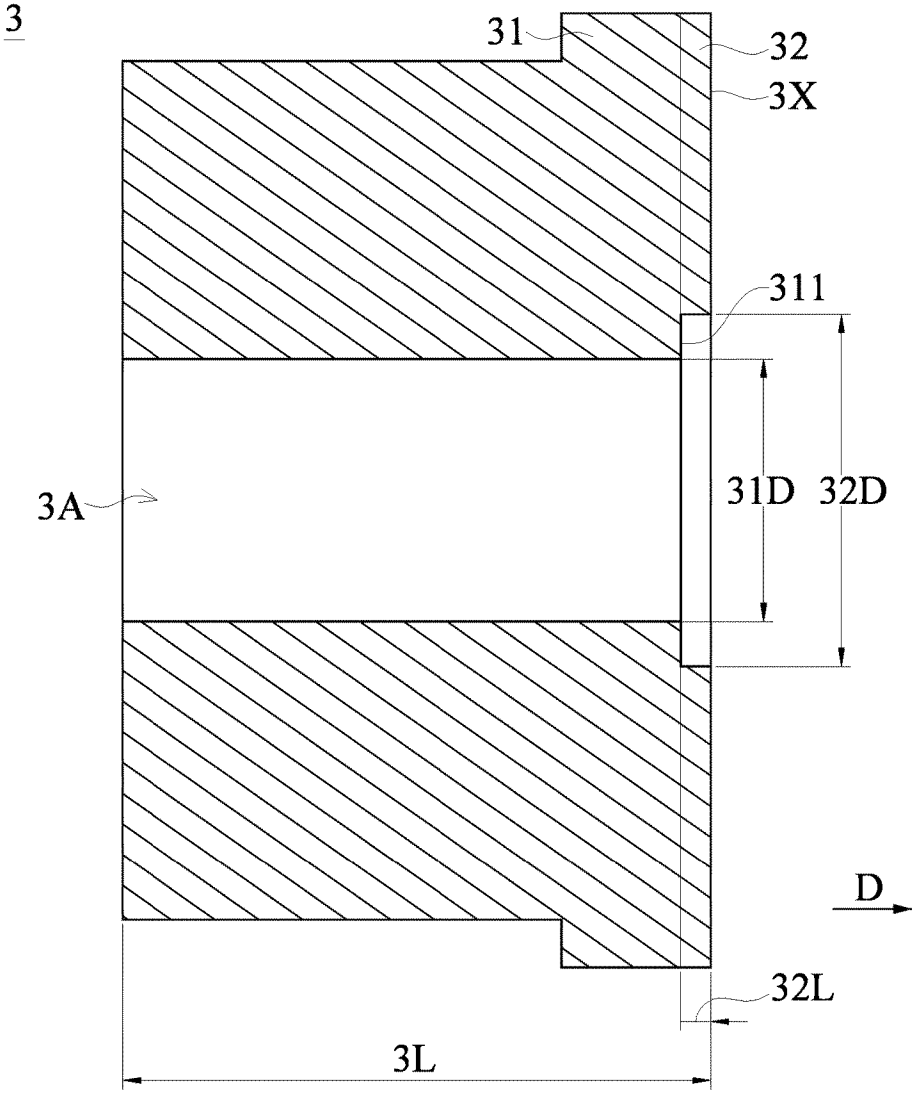
FIG. 7 is a sectional view of a second fixing member of the coaxial connector according to the present disclosure.

Referring to FIG. 3, FIG. 4, and FIG. 7, the second fixing member 3 has a second thru-hole 3A penetrating through the second fixing member 3 along the axial direction D. The second fixing member 3 includes a second inner annular portion 31 and a second inner engaging portion 32, the second inner annular portion 31 and the second inner engaging portion 32 are arranged at two ends of the second fixing member 3. The second inner annular portion 31 has an annular structure, and an inner diameter 31D of the second inner annular portion 31 is uniform from one end of the second fixing member 3 to another end of the second fixing member 3. The inner diameter 31D of the second inner annular portion 31 is less than an inner diameter 32D of the second inner engaging portion 32, and the second inner annular portion 31 has an inner annular end surface 311 at one end thereof near the second inner engaging portion 32. The second inner engaging portion 32 has an annular structure, the second inner engaging portion 32 is connected to the second inner annular portion 31, and the inner diameter 32D of the second inner engaging portion 32 is uniform from the one end of the second fixing member 3 to the another end of the second fixing member 3.

When the second fixing member 3 is fixed in the shell 1, the second inner engaging portion 32 and one portion of the second inner annular portion 31 are engaged in the outer engaging portion 13, and an end surface 2X of the first fixing member 2 and an end surface 3X of the second fixing member 3 abut against each other. In a preferred embodiment, a length 32L of a section of the second inner engaging portion 32 engaged in the outer engaging portion 13 along the axial direction D is less than the length 3L of the second fixing member 3 along the axial direction D.

Figure 8:
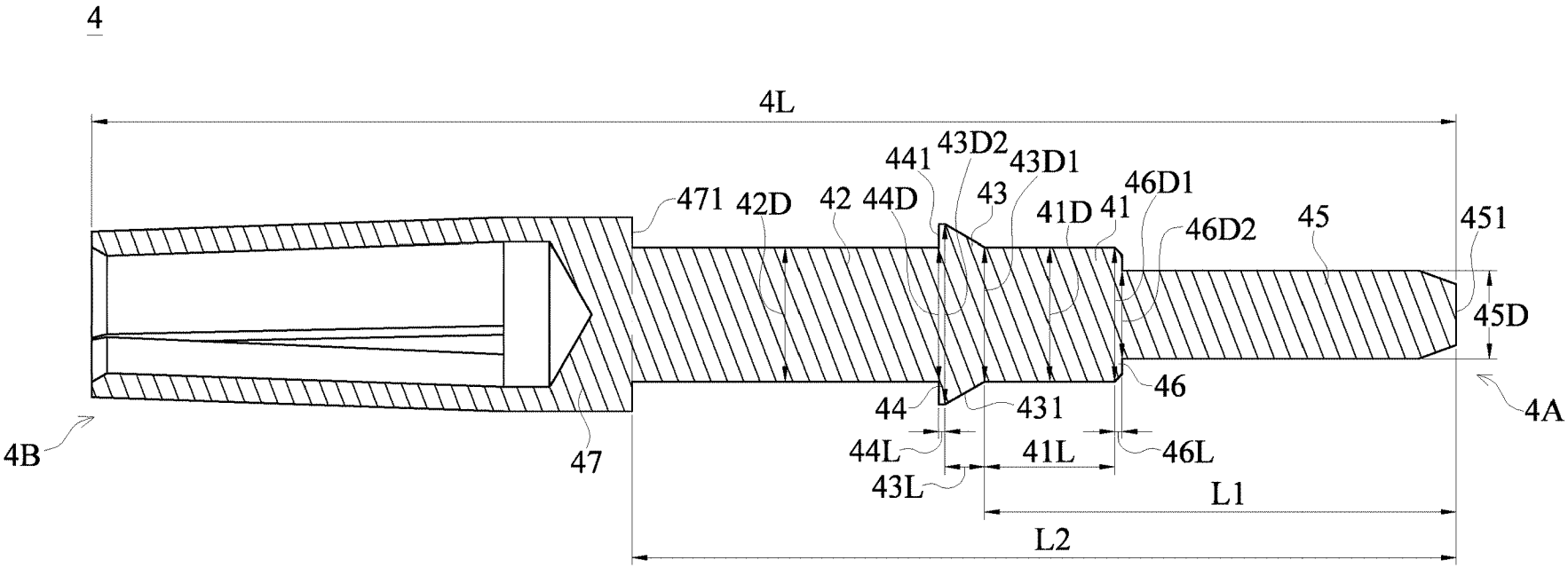
FIG. 8 is a sectional view of a core body of the coaxial connector according to the present disclosure.

Referring to FIG. 3, FIG. 4, and FIG. 8, the core body 4 defines a third end 4A and a fourth end 4B opposite to each other. The core body 4 includes a first portion 41, a second portion 42, an engaging portion 43, an auxiliary engaging portion 44, an abutting portion 45, a guiding portion 46, and a mating portion 47. The core body 4 sequentially includes the abutting portion 45, the guiding portion 46, the first portion 41, the engaging portion 43, the auxiliary engaging portion 44, the second portion 42, and the mating portion 47 from the third end 4A to the fourth end 4B.

The first portion 41 is near the third end 4A, and an outer diameter 41D of the first portion 41 is uniform from the third end 4A to the fourth end 4B. A sum of a length 41L of the first portion 41 along the axial direction D and a length 46L of the guiding portion 46 along the axial direction D can be substantially equal to the length 21L of the first inner annular portion 21 along the axial direction D.

The engaging portion 43 is arranged between the first portion 41 and the second portion 42, an outer diameter 43D of the engaging portion 43 gradually increases from the third end 4A to the fourth end 4B, the engaging portion 43 has an outer annular abutting inclined surface 431, a minimum outer diameter 43D1 of the engaging portion 43 is greater than or equal to the outer diameter 41D of the first portion 41, and a maximum outer diameter 43D2 of the engaging portion 43 is greater than an outer diameter 42D of the second portion 42. In a practical application, the minimum outer diameter 43D1 of the engaging portion 43 can be substantially equal to the outer diameter 41D of the first portion 41.

Preferably, a length 43L of the engaging portion 43 along the axial direction D is less than a length 4L of the core body 4 along the axial direction D. A length L1 from a position of the engaging portion 43 having the minimum outer diameter along the axial direction D to an end surface 451 of the abutting portion 45 is less than a length L2 from the end surface 451 of the abutting portion 45 along the axial direction D to an end surface 471 where the abutting portion 47 and the second portion 42 are connected to each other.

The auxiliary engaging portion 44 is connected to the engaging portion 43, the auxiliary engaging portion 44 is arranged at one end of the engaging portion 43 having the maximum outer diameter, an outer diameter 44D of the auxiliary engaging portion 44 is uniform from the third end 4A to the fourth end 4B, and the outer diameter 44D of the auxiliary engaging portion 44 is substantially equal to the maximum outer diameter 43D2 of the engaging portion 43. A length 44L of the auxiliary engaging portion 44 along the axial direction D is less than or equal to the length 32L (as shown in FIG. 7) of the second inner engaging portion 32 along the axial direction D, and when the engaging portion 43 and the auxiliary engaging portion 44 are engaged in the first inner engaging portion 22 and the second engaging portion 32, the auxiliary engaging portion 44 is correspondingly engaged in the second inner engaging portion 32.

A sum of the length 44L of the auxiliary engaging portion 44 along the axial direction D and the length 43L of the engaging portion 43 along the axial direction D is equal to a sum of the length 22L (as shown in FIG. 6) of the first inner engaging portion 22 along the axial direction D and the length 32L (as shown in FIG. 7) of the second inner engaging portion 32 along the axial direction D. When the core body 4 is fixed in the shell 1 through the first fixing member 2 and the second fixing member 3, one portion of the engaging portion 43 is engaged in the first inner engaging portion 22, and another portion of the engaging portion 43 and the auxiliary engaging portion 44 are engaged in the second inner engaging portion 32 together. One portion of the outer annular abutting inclined surface 431 and the inner annular abutting inclined surface 221 of the first fixing member 2 abut against each other, and an outer annular end surface 441 of the core body 4 and the inner annular end surface 311 of the second fixing member 3 correspondingly abut against each other.

In a preferred embodiment, the length 44L of the auxiliary engaging portion 44 along the axial direction D is less than the length 43L of the engaging portion 43 along the axial direction D. The length 44L of the auxiliary engaging portion 44 along the axial direction D is less than the length 32L of the second inner engaging portion 32 along the axial direction D.

The guiding portion 46 is connected to the first portion 41, the guiding portion 46 is connected to the abutting portion 45, the guiding portion 46 is arranged between the first portion 41 and the abutting portion 45, and an outer diameter of the guiding portion 46 gradually decreases from the third end 4A to the fourth end 4B.

The mating portion 47 is configured to be inserted by a core body of a connection wire, and the mating portion 47 is connected to the second portion 42. The appearance of the mating portion 47 is not limited to that shown FIG. 2, FIG. 3, and FIG. 8, and can be changed according to practical requirements. The abutting portion 45 is configured to abut against a conductive pad of a circuit board, the abutting portion 45 is connected to the first portion 41, and the outer diameter 45D of the abutting portion 45 is less than the outer diameter 41D of the first portion 41. In a preferred embodiment, one portion of the abutting portion 45 protrudes from the first end 1A of the shell 1.

A proportion between each of the length of the first portion 41, the length of the second portion 42, the length of the abutting portion 45, and the length of the mating portion 47 along the axial direction D and the length 4L of the core body 4 along the axial direction D can be changed according to practical requirements, the figures only show one embodiment of the present embodiment, but the present disclosure is not limited thereto.

Referring to FIG. 3 to FIG. 8, a mounting method of the coaxial connector 100 of the present disclosure is as follows. Firstly, the first fixing member 2 is inserted into the fixing thru-hole 1C from one end of the shell 1 having the second outer annular portion 12, and the first inner engaging portion 22 and one portion of the first inner annular portion 21 are correspondingly engaged in the outer engaging portion 13. It should be noted that, since the inner diameter 12D of the second outer annular portion 12 is smaller than the inner diameter 13D of the outer engaging portion 13, and the outer diameter 22D of the first inner engaging portion 22 and the outer diameter 21D of the one portion of the first inner annular portion 21 are greater than the inner diameter 12D of the second outer annular portion 12, in a process where the first fixing member 2 is inserted into the shell 1, the technical personnel can clearly feel whether or not the first inner engaging portion 22 is entered into the outer engaging portion 13.

After the first fixing member 2 is fixed in the shell 1 by the technical personnel, one end of the core body 4 having the abutting portion 45 is then inserted into the shell 1 from the one end of the shell 1 having the second outer annular portion 12, so that the abutting portion 45, the first portion 41, and one portion of the engaging portion 43 are correspondingly engaged in the first thru-hole 2C of the first fixing member 2.

In a process where the core body 4 is fixed into the first fixing member 2, since a slope of the outer annular abutting inclined surface 431 of the engaging portion 43 is substantially equal to a slope of the inner annular abutting inclined surface 221, an obvious abrasion issue between the engaging portion 43 and the first fixing member 2 cannot occur.

Finally, one end of the second fixing member 3 having the second inner engaging portion 32 is inserted into the shell 1 from the one end of the shell 1 having the second outer annular portion 12, so that the second inner engaging portion 32 is engaged in the outer engaging portion 13. At this time, one portion of the engaging portion 43 and the auxiliary portion 44 are engaged in the second inner engaging portion 32.

It is worth mentioning that in a preferred embodiment, a sum of the length 21L1 (as shown in FIG. 4) of the section of the first inner annular portion 21 engaged in the outer engaging portion 13 along the axial direction D, the length 22L (as shown in FIG. 6) of the first inner engaging portion 22, the length 32L (as shown in FIG. 4) of the second inner engaging portion 32, and the length 31L (as shown in FIG. 4) of the section of the second inner annular portion 31 engaged in the outer engaging portion 13 along the axial direction D can be slightly greater than the length 13L (as shown in FIG. 5) of the outer engaging portion 13 along the axial direction D, and the first inner engaging portion 22, one portion of the first inner annular portion 21, the second inner engaging portion 32, and one portion of the second inner annular portion 31 are engaged in the outer engaging portion 13 together in a tight cooperation. In this way, the first fixing member 2 and the second fixing member 3 can better hold the engaging portion 43 and the auxiliary engaging portion 44, so that one end of the core body 4 that is exposed from the shell 1 cannot easily move into the shell 1 due to an external force.

Since the outer diameter of the auxiliary engaging portion 44 is uniform, and the length 32L (as shown in FIG. 7) of the second inner engaging portion 32 along the axial direction D is greater than the length 44L (as shown in FIG. 8) of the auxiliary engaging portion 44 along the axial direction D, in a process where the second inner engaging portion 32 is engaged with the auxiliary engaging portion 44 and one portion of the engaging portion 43, an abrasion issue between the auxiliary engaging portion 44 or the one portion of the engaging portion 43 and the second inner engaging portion 32 does not easily occur.

In addition, it is worth mentioning that when the coaxial connector 100 of the present disclosure is fixed to a circuit board, the circuit board provides an external force to the one end of the core body 4 that is exposed from the shell 1, so that the external force allows the core body 4 to move inwards toward the shell 1. However, since the external annular end surface 441 and the inner annular end surface 331 abut against each other, and one portion of the second fixing member 3 is disposed in the outer engaging portion 13, the core body 4 cannot easily move inwards toward the shell. Even if the core body 4 moves inward toward the shell 1, a movement extent of the core body 4 is relatively small. Accordingly, it can be ensured that the one portion of the core body 4 that is exposed from the shell 1 effectively abuts against the conductive pad of the circuit board.

Figure 9:
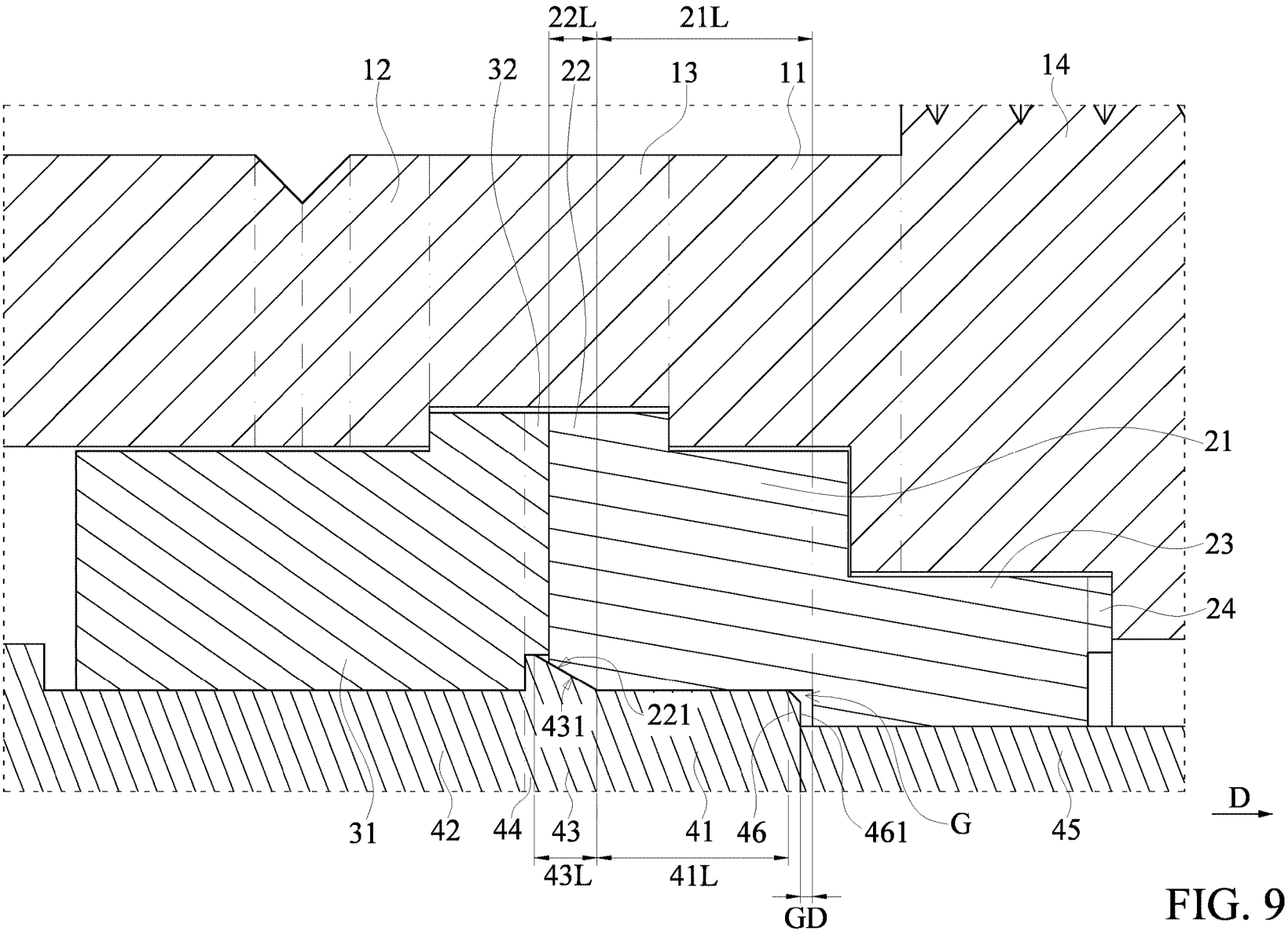
FIG. 9 is a partial sectional view of the coaxial connector according to one embodiment of the present disclosure.

Referring to FIG. 9, it is worth mentioning that in other embodiments, the sum of the length 43L of the engaging portion 43 along the axial direction D and the length 41L of the first portion 41 along the axial direction D can be greater than the sum of the length 22L of the first inner engaging portion 22 along the axial direction D and the length 21L of the first inner annular portion 21 along the axial direction D. When the outer annular abutting inclined surface 431 and the inner annular abutting inclined surface 221 abut against each other, a gap G exists between an end surface 461 where the guiding portion 46 and the abutting portion 45 are connected to each other and an end surface 231 of the first inner end portion 23 near the first inner annular portion 21. A length GD of the gap G along the axial direction D can be adjusted, so that the impedance of the coaxial direction 100 can be correspondingly adjusted, and the coaxial connector 100 can reach the impedance matching requirement.

Beneficial Effects of the Embodiments

In conclusion, through the design of the shell, the first fixing member, the second fixing member, and the core body, after the coaxial connector of the present disclosure is mounted onto the circuit board, the core body cannot easily move inwards toward the shell due to an external force. Therefore, after the coaxial connector of the present disclosure is mounted onto the circuit board, the core body can be effectively in contact with a conductive pad of the circuit board, and the coaxial connector can more stably transmit signals compared to a conventional coaxial connector.

The foregoing description of the exemplary embodiments of the disclosure has been presented only for the purposes of illustration and description and is not intended to be exhaustive or to limit the disclosure to the precise forms disclosed. Many modifications and variations are possible in light of the above teaching.

The embodiments were chosen and described in order to explain the principles of the disclosure and their practical application so as to enable others skilled in the art to utilize the disclosure and various embodiments and with various modifications as are suited to the particular use contemplated. Alternative embodiments will become apparent to those skilled in the art to which the present disclosure pertains without departing from its spirit and scope.

What is claimed is:

1. A coaxial connector, comprising:

a shell having a fixing thru-hole penetrating through the shell along an axial direction;

a first fixing member having a first thru-hole penetrating through the first fixing member along the axial direction, wherein the first fixing member includes:

a first inner annular portion having an annular structure;

a first inner engaging portion having an annular structure, wherein the first inner engaging portion is connected to the first inner annular portion, an inner diameter of the first inner engaging portion gradually increases from one end of the first fixing member to another end of the first fixing member, and the first inner engaging portion has an inner annular abutting inclined surface formed therein;

a first inner end portion having an annular structure, wherein the first inner end portion is connected to the first inner annular portion, and the first inner annular portion is arranged between the first inner engaging portion and the first inner end portion; and an auxiliary portion having an annular structure, wherein an inner diameter of the auxiliary portion is greater than an inner diameter of the first inner end portion, and a length of the auxiliary portion along the axial direction is less than a length of the first fixing member along the axial direction;

a second fixing member having a second thru-hole penetrating through the second fixing member along the axial direction, wherein the second fixing member includes:

a second inner annular portion having an annular structure, wherein the second inner annular portion has an inner annular end surface at one end thereof; and a second inner engaging portion having an annular structure, wherein the second inner engaging portion is connected to the second inner annular portion, an inner diameter of the second inner engaging portion is greater than an inner diameter of the second inner annular portion, and the inner diameter of the second inner engaging portion is uniform from one end of the second fixing member to another end of the second fixing member, wherein the first fixing member and the second fixing member are engaged in the fixing thru-hole of the shell, and an end surface of the first fixing member and an end surface of the second fixing member abut against each other; and a core body including:

a first portion;

a second portion;

an engaging portion arranged between the first portion and the second portion, wherein an outer diameter of the engaging portion gradually increases from one end of the core body to another end of the core body, the engaging portion has an outer annular abutting inclined surface, a minimum outer diameter of the engaging portion is greater than or equal to an outer diameter of the first portion, and a maximum outer diameter of the engaging portion is greater than an outer diameter of the second portion, and wherein a length of the engaging portion along the axial direction is greater than a length of the first inner engaging portion along the axial direction; and an auxiliary engaging portion connected to one end of the engaging portion having the maximum outer diameter, wherein an outer diameter of the auxiliary engaging portion is equal to the maximum outer diameter of the engaging portion, the outer diameter of the auxiliary engaging portion is uniform, and the auxiliary engaging portion has an outer annular end surface at an end thereof opposite to a position where the auxiliary engaging portion is connected to the engaging portion, wherein one portion of the core body penetrates through the first thru-hole, the one portion of the core body penetrates through the second thru-hole, the first inner engaging portion and the second inner engaging portion jointly hold the engaging portion and the auxiliary engaging portion together, the inner annular abutting inclined surface and one portion of the outer annular abutting inclined surface abut against each other, and the outer annular end surface and the inner annular end surface abut against each other.

2. The coaxial connector according to claim 1, wherein the shell defines a first end and a second end that are opposite to each other, and the shell includes:

a first outer annular portion having an annular structure and near the first end;

a second outer annular portion having an annular structure and near the second end; and an outer engaging portion having an annular structure and arranged between the first outer annular portion and the second outer annular portion, wherein an inner diameter of the outer engaging portion is greater than an inner diameter of the first outer annular portion, and the inner diameter of the outer engaging portion is greater than an inner diameter of the second outer annular portion, and wherein the first inner engaging portion, one portion of the first inner annular portion, the second inner engaging portion, and one portion of the second inner annular portion are engaged in the outer engaging portion;

wherein the inner diameter of the outer engaging portion is uniform from the first end to the second end, the inner diameter of the first outer annular portion is uniform from the first end to the second end, the inner diameter of the second outer annular portion is uniform from the first end to the second end, an inner diameter of the first inner annular portion is uniform from the one end of the first fixing member to the another end of the first fixing member, the inner diameter of the second inner annular portion is uniform from the one end of the first fixing member to the another end of the first fixing member, the outer diameter of the first portion is uniform from the one end of the core body to the another end of the core body, and the outer diameter of the second portion is uniform from the one end of the core body to the another end of the core body.

3. The coaxial connector according to claim 1, wherein a length of the auxiliary engaging portion along the axial direction is less than a length of the engaging portion along the axial direction.

4. The coaxial connector according to claim 1, wherein a length of the second inner engaging portion along the axial direction is greater than a length of the auxiliary engaging portion along the axial direction.

5. The coaxial connector according to claim 1, wherein a length of the outer engaging portion along the axial direction is less than a length of the shell along the axial direction.

6. The coaxial connector according to claim 2, wherein the shell further includes a connection portion and an outer end portion, the connection portion has an annular structure, and the outer end portion has an annular structure, wherein the connection portion is connected to the first outer annular portion, the connection portion is connected to the outer end portion, and the connection portion is arranged between the first outer annular portion and the outer end portion, and wherein an inner diameter of the connection portion is less than the inner diameter of the first outer annular portion, and an inner diameter of the outer end portion is less than the inner diameter of the connection portion.

7. The coaxial connector according to claim 2, wherein the inner diameter of the first inner end portion is less than the inner diameter of the first inner annular portion, the one portion of the first inner annular portion and one portion of the first inner end portion are engaged in the first outer annular portion, and another portion of the first inner end portion is engaged in the connection portion.

8. The coaxial connector according to claim 7, wherein a length of a section of the first inner annular portion engaged in the outer engaging portion along the axial direction is less than a length of the first inner annular portion along the axial direction, and wherein a length of a section of the first inner end portion engaged in the first outer annular portion along the axial direction is less than a length of the first inner end portion along the axial direction.

9. The coaxial connector according to claim 7, wherein the core body defines a third end and a fourth end that are opposite to each other, and the inner diameter of the auxiliary portion is uniform from the third end to the fourth end.

10. The coaxial connector according to claim 1, wherein the length of the first inner engaging portion along the axial direction is less than the length of the engaging portion along the axial direction, and a length of the second inner engaging portion along the axial direction is less than the length of the engaging portion along the axial direction.

11. The coaxial connector according to claim 1, wherein a length of the second inner engaging portion along the axial direction is less than a length of the second fixing member along the axial direction, and the length of the engaging portion along the axial direction is less than a length of the core body along the axial direction.

* * * * *